United States Patent [19]

Takizawa et al.

[11] Patent Number: 4,686,083

[45] Date of Patent: Aug. 11, 1987

[54] ALUMINUM ALLOY SUPPORT FOR A LITHOGRAPHIC PRINTING PLATE

[75] Inventors: Kazushige Takizawa; Hirokazu Sakaki, both of Shizuoka; Yuji Abe; Mamoru Matsuo, both of Fukaya; Akira Tajiri, Kawamoto; Shin Tsuchida, Nagoya, all of Japan

[73] Assignees: Fuji Photo Film Co., Ltd., Kanagawa; Sumitomo Light Metal Industries, Ltd.; Skyaluminium Co., Ltd., both of Tokyo, all of Japan

[21] Appl. No.: 727,475

[22] Filed: Apr. 26, 1985

[30] Foreign Application Priority Data

Apr. 27, 1984 [JP] Japan ..... 59-83874

[51] Int. Cl.[4] ..... C22C 21/00

[52] U.S. Cl. ..... 420/548; 101/459; 420/551; 420/553

[58] Field of Search ..... 420/528, 548, 550, 551, 420/553; 148/11.5 A, 31.5, 437; 101/459

[56] References Cited

U.S. PATENT DOCUMENTS

| | | | |
|---|---|---|---|
| 3,944,439 | 3/1976 | Pryor et al. | 101/459 |
| 4,435,230 | 3/1984 | Fujikura | 148/11.5 A |

FOREIGN PATENT DOCUMENTS

| | | | |
|---|---|---|---|
| 0067056 | 12/1982 | European Pat. Off. . | |
| 96347 | 12/1983 | European Pat. Off. | 101/459 |
| 2108511 | 9/1971 | Fed. Rep. of Germany . | |
| 1595159 | 7/1970 | France . | |
| 2336261 | 7/1977 | France . | |
| 39403 | 3/1977 | Japan | 101/459 |
| 15396 | 2/1981 | Japan | 101/459 |
| 63347 | 4/1985 | Japan | 101/459 |

*Primary Examiner*—L. Dewayne Rutledge
*Assistant Examiner*—Robert L. McDowell
*Attorney, Agent, or Firm*—Armstrong, Nikaido, Marmelstein & Kubovcik

[57] ABSTRACT

An aluminum alloy support for a lithographic printing plate, suitable for an electrochemical roughening treatment and excellent in fatigue resistance, heat softening resistance and printability, is provided which comprises 0.05 to less than 1% by weight of Mn, at most 0.2% by weight of Si, at most 0.5% by weight of Fe and unavoidable amounts of impurities.

5 Claims, No Drawings

ALUMINUM ALLOY SUPPORT FOR A LITHOGRAPHIC PRINTING PLATE

BACKGROUND OF THE INVENTION

1. Field of the Invention

This invention relates to a support of aluminum alloy used for a lithographic printing plate and more particularly, it is concerned with an aluminum alloy support for a lithographic printing plate, which is excellent in fatigue resistance, thermoplastic property and printability.

2. Description of the Prior Art

Lithographic printing plates which have generally been used are obtained by submitting the so-called presensitized printing plates (which will hereinafter be referred to as "PS plates") to plate making processings such as steps of imagewise exposing, developing, gum coating and so on. The PS plates are prepared by coating light-sensitive materials onto aluminum plates having the surfaces subjected to surface treatments such as surface roughening and anodic oxidation treatments and then drying them. It is well known that an area where the light-sensitive layer remains undissolved after the above described developing step forms an image part and the other area where the light-sensitive layer is removed to expose the underlying aluminum surface becomes water-acceptable and thus forms a non-image part because of being hydrophilic.

As the support for such a lithographic printing plate, there have generally been used aluminum plates of light weight, excellent in adaptability to surface treatments and machining as well as corrosion resistance. Conventional materials used for this purpose are aluminum alloy plates with a thickness of 0.1–0.8 mm according to JIS A 1050 (Al alloys of a purity of at least 99.5 wt %), JIS A 1100 (Al-0.05–0.20 wt % Cu alloys) and JIS A 3003 (Al-0.05–0.20 wt % Cu-1.5 wt % Mn alloys) which surfaces are roughened by either or at least two of mechanical, chemical and electrochemical treatments and then subjected to anodic oxidation.

More specifically, there have hitherto been proposed aluminum lithographic printing plates which are subjected in sequence to a mechanical surface roughening treatment, chemical etching treatment and anodically oxidized film forming processing, as described in U.S. Pat. No. 3,834,998; which are subjected in sequence to a chemical etching treatment and anodically oxidized film forming processing, as described in Japanese Patent Application OPI (Kokai) No. 61304/1976; which are subjected in sequence to an electrochemical treatment, aftertreatment and anodically oxidized film forming processing, as described in Japanese Patent Application OPI (Kokai) No. 146234/1979; which are subjected in sequence to an electrochemical treatment, chemical etching treatment and anodically oxidized film forming processing, as described in Japanese Patent Application OPI (Kokai) No. 28123/1973; and which are subjected to a mechanical surface roughening treatment and subsequently to the treatments described in Japanese Patent Application OPI (Kokai) No. 28123/1973.

Up to 100,000 sheets of clear prints can be obtained by providing a suitable light-sensitive layer on such a support, but it is still desired to obtain a further great number of prints from one printing plate (improvement of printing resistance). To this end, it is effective to subject a PS plate using an aluminum alloy plate as a support to exposure, development and heat treatment at a high temperature, i.e. so-called burning treatment, thereby strengthening an image part, as described in detail in Japanese Patent Publication Nos. 27243/1969 and 27244/1969. In this burning treatment, the heating temperature and time, depending upon the variety of the resin used for forming the image, are generally 200° to 280° C. and 3 to 7 minutes.

Lately, it has been required that this burning treatment is carried out at a high temperature in a short time so as to shorten the time for the burning temperature. When the commonly used aluminum alloy plates are heated at a high temperature, e.g. 280° C. or higher, however, recrystallization of aluminum takes place, the strength thereof is extremely lowered and the printing plates are not firm, thus resulting in drawbacks that handling thereof is very difficult and it is impossible to set in printing machines or to subject to registering in multicolor printing. Therefore, the demand for a support consisting of an aluminum alloy plate which is stable and excellent in heat resistance is increasing.

Lately, printing speeds have been increased with the progress of the printing technique. Accordingly, this causes an increase in the stress applied to the printing plate which is fixed mechanically to both the ends of a rotating cylinder installed in a printing machine and when the strength of the aluminum printing plate is insufficient under the increased stress, there occur deformation or break of the printing plate at the fixed parts resulting in a shear in printing and cut of the printing plate due to repeated stress at the bent part thereof, whereby to make it impossible to continue the printing operation.

Aluminum alloy plates of the prior art according to JIS A 1050 can provide a uniform rough surface and suitable surface roughness in an electrochemical surface roughening treatment and can avoid strains on a non-image area during printing, but are inferior in fatigue resistance and heat softening resistance. On the other hand, aluminum alloy plates of the prior art according to JIS A 3003 have a sufficient fatigue resistance and heating softening resistance, but meet with the disadvantages that a uniform rough surface and suitable surface roughness are hardly obtained by an electrochemical surface roughening treatment and stains tend to occur on a non-image area during printing.

SUMMARY OF THE INVENTION

It is an object of the present invention to provide an aluminum alloy support used for a lithographic printing plate, whereby the above described disadvantages can be overcome.

It is another object of the present invention to provide an aluminum alloy support having a sufficient fatigue resistance as well as a high heat softening resistance as a printing plate.

It is a further object of the present invention to provide an aluminum alloy support for a lithographic printing plate, capable of giving a uniform rough surface and a suitable surface roughness by a surface roughening treatment, in particular, electrochemical surface roughening treatment, and being free from stains on a non-image area during printing.

These objects can be attained by an aluminum alloy support for a lithographic printing plate, containing 0.05 to less than 1.0% of Mn, at most 0.20% of Si, at most 0.50% of Fe and unavoidable quantity of impurities.

DETAILED DESCRIPTION OF THE INVENTION

The feature of the present invention consists in that the support for a lithographic printing plate consists of an aluminum alloy containing 0.05 to 1% by weight or less, preferably 0.05 to 0.80% by weight of Mn, 0.2% by weight or less, preferably 0.02 to 0.15% by weight of Si, 0.5% by weight or less, preferably 0.05 to 0.25% by weight of Fe and unavoidable amounts of impurities. All percents described hereinafter are to be taken as those by weight.

Mn is added to aluminum for the purpose of improving the strength and heat softening resistance without affecting unfavourably the surface roughening treatment and printing property or printability. If the quantity of Mn is less than 0.05%, the strength is insufficient, while if more than 1%, a uniform rough surface cannot be obtained by an electrochemical roughening method and a coarse compound of $Al_6Mn$ is formed to cause stains during printing.

Fe serves to raise the fatigue resistance. If Fe exceeds 0.5% and Si exceeds 0.2%, however, this components form compounds of Al-Fe-Si, Al-Si and Al-Fe, thus resulting often in stains.

The aluminum alloy of the present invention may contain impurities in such a quantity as contained in commercially available aluminum alloys without missing the object of the present invention.

Ti and B, generally used as a fine crystal forming agent in the production of an ingot, are admitted respectively in proportions of up to 0.1% and 0.02% without missing the object of the present invention.

The aluminum alloy of the present invention is formed into a thin plate by a continuous casting process using a mold or by another process comprising solidifying between a pair of cooled rolls or plates and then subjecting to hot rolling and cold rolling, optionally with intermediate annealing.

In the aluminum alloy support according to the present invention, it is effective in order to further improve the fatigue resistance as well as heat softening resistance to reduce the residual stress accumulated in the support. When the material strength and elongation are varied by varying the extent of a finishing cold rolling and the finishing annealing temperature to known the relationship with the fatigue life, it is found that the fatigue life is sufficient if the elongation amounts to at least 5%. The stiffness as a support for a lithographic printing plate offers no problem on practical use at a proof stress of at least 10 kg/mm$^2$. A preferred proof stress is at least 15 kg/mm$^2$.

A useful process for obtaining these material properties comprises effecting a finishing cold rolling in a proportion of 10 to 50% after the intermediate annealing or effecting a softening treatment (finishing annealing) at a temperature of 200° to 320° C. after the finishing cold rolling.

Processes for the surface treatment of the aluminum alloy support for a lithographic printing plate according to the present invention are described in detail below.

Suitable examples of the graining process which can be applied to the aluminum alloy support of the present invention include electrochemical graining processes, in which graining is carried out in electrolytic solutions containing hydrochloric acid or nitric acid by passing an electric current, and mechanical graining processes such as a wire brush graining process wherein aluminum surfaces are scratched by a metal wire, a ball graining process wherein aluminum surfaces are rubbed by abrasive balls and abrasives, a brush graining process wherein aluminum surfaces are rubbed by a nylon brush and abrasives, and the like. These graining processes may be employed independently or in combination. The electrochemical graining processes have the advantages that a uniform rough surface and suitable surface roughness can be obtained and stains hardly occur on a non-image area during printing.

After the graining process, the aluminum plate is subjected to chemical etching processing using an acid or alkali. If an acid is used as the etching agent, it takes a very long time to destroy the fine structure. Accordingly, it is preferable, in general, to use an alkali as the etching agent.

Examples of the alkali agent which can advantageously be used in the present invention include sodium hydroxide, sodium carbonate, sodium aluminate, sodium metasilicate, sodium phosphate, potassium hydroxide, lithium hydroxide and the like. Of these agents, sodium aluminate is preferred. A preferable concentration of such an alkali in the etching solution and a preferable temperature for the etching processing range respectively 1 to 50% and 20° to 100° C. so as to dissolve the aluminum in an amount of 5 to 20 g/m$^2$.

After the etching process, the aluminum alloy plate is pickled with an acid to remove smut remaining on its surface. Examples of the acid which can be used for this purpose include nitric acid, sulfuric acid, phosphoric acid, chromic acid, hydrofluoric acid, borofluoric acid and the like. For the removal of smut, in particular, after an electrochemical surface roughening treatment, there can favourably be used a method as described in Japanese Patent Application OPI (Kokai) No. 12739/1958, wherein the smut is removed by contacting with 15 to 65 wt % sulfuric acid at a temperature of 50° to 90° C., and an alkali etching method as described in Japanese Patent Publication No. 28123/1973.

The thus processed aluminum plates can be used as the support for a lithographic printing plate and if necessary, they are preferably submitted further to an anodic oxidation film forming processing, chemical processing or the like.

The anodic oxidation processing can be carried cut using techniques which have so far been employed in the art. For example, an anodically oxidized film can be formed on the surface of an aluminum support by passing DC or AC current through the aluminum support in an aqueous or non-aqueous solution sulfuric acid, phosphoric acid, chromic acid, oxalic acid, sulfamic acid, benzenesulfonic acid or a mixture of two or more of these acids.

The processing conditions of the anodic oxidation are changed depending on what kind of electrolytic solution is used and, therefore, they cannot be determined indiscriminately. However, as a general guide, it can be said that an electrolytic solution having a concentration of 1 to 80 wt %, a solution temperature of 5° to 70° C., a current density of 0.5 to 60 ampere/dm$^2$, a voltage of 1 to 100 V and an electrolyzing time of 10 to 100 seconds can produce preferable results.

Particularly effective anodically oxidized film forming processes are those described in British Pat. No. 1,412,768, wherein anodic oxidation is carried out in sulfuric acid at a high current density, and described in U.S. Pat. No. 3,511,661, wherein anodic oxidation is carried out using phosphoric acid as an electrolytic bath.

The aluminum plate which has been anodically oxidized may further be treated with an aqueous solution of an alkali metal silicate such as sodium silicate or the like in conventional manner, e.g. a dipping technique, as described in U.S. Pat. Nos. 2,714,066 and 3,181,461. Alternatively, a subbing layer made up of hydrophilic cellulose (e.g., carboxymethyl cellulose, etc.) containing a water-soluble metal salt (e.g., zinc acetate, etc.) can additionally be provided on the anodic-alloy oxidized aluminum plate, as described in U.S. Pat. No. 3,860,426.

On the aluminum alloy support for a lithographic printing plate according to the present invention can be provided a light-sensitive layer which is known to have been used for PS plates to produce a presensitized lithographic printing plate. The lithographic printing plate obtained by subjecting this PS plate to a plate making process has excellent performances.

Suitable examples of the composition for the above described light-sensitive layer are described below:

(1) Light-sensitive layer comprised of a diazo resin and a binder

Preferably, a condensate of formaldehyde and diphenylamine-p-diazonium salt, reaction product of a diazonium salt and an organo condensing agent containing reactive carbonyl group such as aldols and acetals (so-called light-sensitive diazo resin) is used as described in U.S. Pat. Nos. 2,063,631 and 1,667,415. Other useful condensed diazo compounds are described in Japanese Patent Publication Nos. 48,001/1974, 45,322/1974 and 45,323/1974.

The light-sensitive diazo compounds of this type can be obtained ordinarily in the form of a water-soluble inorganic salt and can thus be coated from aqueous solutions. Alternatively, these water-soluble diazo compounds are reacted with aromatic or aliphatic compounds having one or more of phenolic hydroxyl group, sulfonic acid group and the both by the process described in Japanese Patent Publication No. 1,167/1972 and the resulting reaction products, i.e. substantially water-insoluble light-sensitive diazo resins can be used. In addition, the water-soluble diazo compounds can be used as reaction products with hexafluorophosphates or tetrafluoroborates, as described in Japanese Patent Application OPI (Kokai) No. 121/031/1981.

(2) Light-sensitive layer comprised of an o-quinonediazide compound

Particularly preferred examples include o-napthoquinonediazide compounds as described in U.S. Pat. Nos. 2,766,118, 2,767,092, 2,772,972, 2,859,112, 2,907,665, 3,046,110, 3,046,111, 3,046,115, 3,046,118, 3,046,119, 3,046,120, 3,046,121, 3,046,122, 3,046,123, 3,061,430, 3,102,809, 3,106,465, 3,635,709, 3,647,443 (incorporated by reference) and many other publications.

(3) Light-sensitive layer comprised of a composition containing an azide compound and a binder (macromolecular compound)

Specific examples of the composition include compositions comprised of azide compounds and water-soluble or alkali-soluble macromolecular compounds which are described in British Pat. Nos. 1,235,281 and 1,495,861 and Japanese Patent Application OPI (Kokai) Nos. 32,331/1976 and 36,128/1976, and compositions comprised of azide group-containing polymers and macromolecular compounds as binders which are described in Japanese Patent Application OPI (Kokai) Nos. 5,102/1975, 84,302/1975, 84,303/1975 and 12,984/1978.

(4) Light-sensitive layers comprised of other light-sensitive resinous compositions Specific Examples include polyester compounds described in U.S. Pat. No. 4,101,326, polyvinyl cinnamate series resins described in British Pat. Nos. 1,112,277, 1,313,309, 1,341,004 and 1,377,747, and photopolymerizable photopolymer compositions described in U.S. Pat. Nos. 4,072,528 and 4,072,527 (incorporated by reference), and the like.

The amount (thickness) of the light-sensitive layer to be provided on the support is controlled to about 0.1 to about 7 g/m$^2$, preferably 0.5 to 4 g/m$^2$.

PS plates, after imagewise exposure, are subjected to processings including a developing step in conventional manner to form resin images. For instance, a PS plate having the light-sensitive layer (1) constituted with a diazo resin and a binder has unexposed portions of light-sensitive layer removed by development after imagewise exposure to produce a lithographic printing plate. On the other hand, a PS plate having a light-sensitive layer (2) has exposed portions of the light-sensitive layer which are removed by development with an alkaline aqueous solution after imagewise exposure to produce a lithographic printing plate.

The following examples are given in order to illustrate the present invention in detail without limiting the same.

EXAMPLE 1

An alloy shown in Table 1 was cast in conventional manner and subjected to cutting of both the surfaces to form an ingot with a thickness of 500 mm, a width of 1000 mm and a length of 3500 mm, optionally homogenizing, hot rolling to a thickness of 1.5 mm, intermediate annealing at 360° C. for 1 hour, finishing cold rolling and finishing annealing to obtain a plate with a thickness of 0.30 mm shown in Table 2.

Sample No. 1 was further subjected to intermediate annealing at a thickness of 0.5 mm and Sample Nos. 2, 3, 4 and 6 were subjected to finishing annealing at 240° to 280° C. for 3 hours. These aluminum alloy plates were then subjected to assessment of the electrochemical etching property, fatigue resistance, heat softening resistance and printability according to the following procedures, thus obtaining results shown in Table 2.

(1) Electrochemical Etching Property

The surface state is observed by means of a scanning electron microscope to assess the uniformity of pits. better: O; good: Δ; bad: x (2) Fatigue Resistance One end of a sample piece bent in 90 degrees at a corner of 2 mmR is repeatedly loaded with a tensile load of 5 kg/mm$^2$ at 25 Hz and the repeated number of loading is measured until broken. Practically, a repeated number of 80,000 is desirable.

(3) Heat Softening Resistance

A sample is heated at 300° C. for 7 minutes in a burning processor (Burning Processor 1300—commercial name—having a heat source of 12 kW manufactured by Fuji Photo Film Co.) and cooled to examine the heat softening property sensuously by hands.

(4) Printability

A printing plate is processed by the following procedure and charged in an offset press KOR (commercial name) to examine the degree of stains on a non-image area.

The printing plate was prepared as follows:

An aluminum alloy plate was subjected to a graining treatment in a suspension of pumice stone and water using rotated nylon brushes and then etched with a 20% aqueous solution of sodium hydroxide so that the amount of aluminum dissolved was 8 g/m$^2$. After the plate was washed thoroughly with running water, it was pickled with a 25% aqueous solution of nitric acid and subsequently washed with water to prepare a base plate. The thus prepared base plate was then subjected to AC electrolysis in an electrolytic bath containing 0.5 to 2.5% of nitric acid with a current density of 20 A/dm$^2$ or more, as described in Japanese Patent Application OPI (Kokai) No. 146,234/1979, and subsequently, the surface of the base plate was cleaned by dipping in a 15% aqueous solution of sulfuric acid at 50° C. for 3 minutes and processed to provide an oxidized film at a coverage of 3 g/m$^2$ in an electrolytic bath containing 20% sulfuric acid as a major component at a bath temperature of 30° C.

On the thus processed sample was provided a light-sensitive layer having the following composition to give a coating thickness of 2.5 g/m$^2$ on dry basis:

| | |
|---|---|
| Ester Compound of Naphthoquinone-1,2-diazido-5-sulfonyl Chloride with Pyrogallol and Acetone Resin (described in Example 1 of U.S. Pat. No. 3,635,709) | 0.75 g |
| Cresol Novolak Resin | 2.00 g |
| Oil Blue 603 (commercial name, product of Orient Chemical Co., Ltd.) | 0.04 g |
| Ethylene Dichloride | 16 g |
| 2-Methoxyethyl Acetate | 12 g |

The thus obtained presensitized printing plate was imagewise exposed for 60 seconds by means of a metal halide lamp of 3 kW placed at a distance of 1 meter, developed with an aqueous solution of sodium silicate having an $SiO_2/Na_2O$ molar ratio of 1.2 and an $SiO_2$ content of 1.5 wt %, washed with water, dried and subjected to gum coating.

TABLE 1

| | Alloy No. | Chemical Components (wt %) | | | | | | | | |
|---|---|---|---|---|---|---|---|---|---|---|
| | | Si | Fe | Cu | Mn | Mg | Cr | Zn | Ti | Al |
| Present Invention | A | 0.06 | 0.13 | 0.02 | 0.12 | 0.00 | 0.00 | 0.00 | 0.08 | 99.59 |
| Comparison | B | 0.10 | 0.28 | 0.00 | 0.01 | 0.00 | 0.00 | 0.00 | 0.01 | 99.60 |

TABLE 2

| | Alloy No. | | | | | |
|---|---|---|---|---|---|---|
| | A Invention | | | | B Comparison | |
| Sample No. | 1 | 2 | 3 | 4 | 5 | 6 |
| Finishing | no | yes | yes | yes | yes | no |
| Annealing Temperature | — | 240° C. | 270° C. | 300° C. | 240° C. | — |
| Tensile Strength (kg/mm$^2$) | 14.8 | 18.9 | 17.9 | 15.6 | 11.9 | 16.0 |
| Proof Stress (kg/mm$^2$) | 12.6 | 16.8 | 13.5 | 11.4 | 11.6 | 15.4 |
| Elongation (%) | 6 | 9 | 12 | 17 | 15 | 3 |
| Electrochemical Etching | O | O | O | O | O | O |
| Fatigue Resistance (× 10$^4$) | 8 | >10 | >10 | >10 | >10 | 6 |
| Heat Softening Resistance | O | O | O | O | O | x |
| Printability | O | O | O | O | x | O |

Sample Nos. 1 to 4 using Alloy A of the present invention each have a higher fatigue resistance, better heat softening resistance, better electrochemical etching property and better printability, while Sample No. 6 using Comparative Alloy B is a commonly used material and Sample No. 6 is a material obtained by subjecting the same to finishing annealing to improve the fatigue life, which is not suitable, however, for practical use because of its low material strength and stains occurring during printing. Sample Nos 2 to 4 according to the present invention are examples wherein the fatigue resistance is largely improved with holding the strength (stiffness) sufficient by subjecting to a finishing annealing treatment.

EXAMPLE 2

An alloy ingot shown in Table 3 was subjected to hot rolling and cold rolling to a thickness of 1.0 mm, intermediate annealing at 360° C. for 1 hour, finishing cold rolling in 70% and finishing annealing at 280° C. to obtain an aluminum alloy plate with a thickness of 0.30 mm. The resulting alloy plates were subjected to assessment of the properties in an analogous manner to Example 1.

Alloy Sample Nos. 7 to 10 of the present invention, in which amounts of Si and Fe are specified and suitable amounts of Mn are added to control the strength and elongation, exhibit more excellent properties in all of the electrochemical etching property, fatigue resistance, heat softening resistance and printability as compared with Comparative Sample Nos. 11 and 12.

TABLE 3

| | Alloy No. | Chemical Components (wt %) Si | Fe | Cu | Mn | Mg | Cr | Zn | Ti | Al |
|---|---|---|---|---|---|---|---|---|---|---|
| Present Invention | C | 0.10 | 0.31 | 0.00 | 0.24 | 0.00 | 0.00 | 0.01 | 0.03 | balance |
| | D | 0.11 | 0.32 | 0.01 | 0.45 | 0.01 | 0.01 | 0.00 | 0.03 | balance |
| | E | 0.16 | 0.45 | 0.01 | 0.12 | 0.01 | 0.00 | 0.00 | 0.02 | balance |
| | F | 0.15 | 0.43 | 0.00 | 0.70 | 0.00 | 0.01 | 0.01 | 0.03 | balance |
| Comparison | G | 0.25 | 0.68 | 0.01 | 0.11 | 0.01 | 0.01 | 0.01 | 0.03 | balance |
| | H | 0.17 | 0.40 | 0.01 | 1.10 | 0.00 | 0.01 | 0.00 | 0.02 | balance |

TABLE 4

| | Sample No. 7 | 8 | 9 | 10 | 11 | 12 |
|---|---|---|---|---|---|---|
| | Our Invention | | | | Comparison | |
| Alloy No. | C | D | E | F | G | H |
| Finishing Annealing | yes | yes | yes | yes | yes | yes |
| Tensile Strength ($kg/mm^2$) | 16.0 | 18.9 | 15.2 | 20.6 | 16.1 | 23.7 |
| Proof Stress ($kg/mm^2$) | 15.2 | 17.6 | 13.5 | 19.8 | 14.0 | 21.4 |
| Elongation (%) | 9 | 8 | 10 | 6 | 9 | 8 |
| Electrochemical Etching | O | O | O | O | x | x |
| Fatigue Resistance ($\times 10^4$) | 9.5 | 10 | 9.5 | >10 | 9 | 10 |
| Heat Softening Resistance | O | O | O | O | O | O |
| Printability | O | O | O | O | x | x |

EXAMPLE 3

Alloy Nos. I, J, K and L of the present invention and Comparative Alloy Nos. M, N, O and P shown in Table 5 were respectively melted and cast, and subjected to cutting of both the surfaces to form an ingot with a thickness of 500 mm, a width of 1000 mm and a length of 3500 mm, optionally homogenizing, hot rolling to a thickness of 4 mm, cold rolling to a thickness of 0.3 mm and finishing annealing at a heating rate of 20° C./hr with holding conditions of 230°–260° C.×5 hrs, thus obtaining aluminum alloy plates I-1, J-1, K-1, L-1, M-1, N-1, O-1 and P-1.

These aluminum alloy plates were surface-treated in an analogous manner to Example 1 to obtain printing plates. The thus resulting printing plates were subjected to assessment of the electrochemical etching property, fatigue resistance, heat softening resistance and printability in an analogous manner to Example 1.

TABLE 5

| Alloy No. | Chemical Components (wt %) Si | Fe | Cu | Mn | Mg | Cr | Zn | Ti | Al | Remark |
|---|---|---|---|---|---|---|---|---|---|---|
| Our Invention | | | | | | | | | | |
| I | 0.08 | 0.07 | 0.00 | 0.83 | 0.00 | 0.00 | 0.00 | 0.03 | balance | |
| J | 0.05 | 0.18 | 0.01 | 0.10 | 0.00 | 0.01 | 0.01 | 0.03 | balance | |
| K | 0.08 | 0.11 | 0.00 | 0.39 | 0.00 | 0.00 | 0.00 | 0.02 | balance | |
| L | 0.07 | 0.24 | 0.00 | 0.42 | 0.01 | 0.00 | 0.00 | 0.03 | balance | |
| Comparison | | | | | | | | | | |
| M | 0.10 | 0.31 | 0.00 | 0.00 | 0.00 | 0.00 | 0.00 | 0.02 | balance | 1050 Alloy |
| N | 0.09 | 0.61 | 0.16 | 0.00 | 0.00 | 0.00 | 0.01 | 0.03 | balance | 1100 Alloy |
| O | 0.12 | 0.56 | 0.00 | 0.00 | 0.01 | 0.00 | 0.01 | 0.03 | balance | 1200 Alloy |
| P | 0.24 | 0.66 | 0.17 | 1.07 | 0.01 | 0.00 | 0.01 | 0.03 | balance | 3003 Alloy |

TABLE 6

| | Sample No. I-1 | J-1 | K-1 | L-1 | M-1 | N-1 | O-1 | P-1 |
|---|---|---|---|---|---|---|---|---|
| | Our Invention | | | | Comparison | | | |
| Alloy No. | I | J | K | L | M | N | O | P |
| Finishing Annealing | yes | yes | yes | yes | yes | yes | yes | yes |

TABLE 6-continued

| | Sample No. I-1 | J-1 | K-1 | L-1 | M-1 | N-1 | O-1 | P-1 |
|---|---|---|---|---|---|---|---|---|
| | Our Invention | | | | Comparison | | | |
| Alloy No. | I | J | K | L | M | N | O | P |
| Tensile Strength ($kg/mm^2$) | 16.2 | 15.6 | 16.0 | 16.1 | 15.6 | 16.7 | 16.0 | 17.2 |
| Proof Stress ($kg/mm^2$) | 15.7 | 14.9 | 15.4 | 15.1 | 14.8 | 15.8 | 15.3 | 16.2 |
| Elongation (%) | 8 | 10 | 8 | 11 | 12 | 8 | 7 | 9 |
| Electro-chemical Etching | O | O | O | O | O | Δ | x | x |
| Fatigue Resistance* ($\times 10^4$) | 10 | 10 | 10 | 9 | 8.5 | 9 | 9 | 8.5 |
| Heat Softening Resistance | O | O | O | O | O | O | O | O |
| Printability | O | O | O | O | x | x | x | x |

Note:
*after burning at 260° C. for 7 minutes

EXAMPLE 4

Of the alloys having the compositions shown in Table 5, Alloys J, K, L, M, N and O were respectively converted into hot rolled plates with a thickness of 4 mm in an analogous manner to Example 3, then cold rolled in a thickness of 0.6 mm, subjected to intermediate annealing at a heating rate of 20° C./hr with holding conditions of 390° C.×2 hrs and cold rolled in a thickness of 0.3 mm to obtain aluminum alloy plates J-2, K-2, L-2, M-2, N-2 and O-2. Printing plates were prepared therefrom in an analogous manner to Example 1 and subjected to examination of the properties, thus obtaining results as shown in Table 7:

TABLE 7

| | Sample No. J-2 | K-2 | L-2 | M-2 | N-2 | O-2 |
|---|---|---|---|---|---|---|
| | Our Invention | | | Comparison | | |
| Alloy No. | J | K | L | M | N | O |
| Finishing Annealing | no | no | no | no | no | no |

TABLE 7-continued

| | Sample No. | | | | | |
|---|---|---|---|---|---|---|
| | J-2 | K-2 | L-2 | M-2 | N-2 | O-2 |
| | Our Invention | | | Comparison | | |
| Alloy No. | J | K | L | M | N | O |
| Tensile Strength (kg/mm$^2$) | 14.2 | 14.7 | 15.1 | 14.6 | 14.6 | 15.3 |
| Proof Stress (kg/mm$^2$) | 14.0 | 14.5 | 15.0 | 14.3 | 14.3 | 15.2 |
| Elongation (%) | 7 | 6 | 6 | 4 | 4 | 5 |
| Electrolytic Etching | O | O | O | O | x | x |
| Fatigue Resistance* ($\times 10^4$) | 10 | 10 | 10 | 6 | 6 | 10 |
| Heat Softening Resistance | O | O | O | x | x | O |
| Printability | O | O | O | O | x | x |

Note:
*after burning at 260° C. for 7 minutes

EXAMPLE 5

The alloys having the compositions shown in Table 5 were respectively converted into hot rolled plates with a thickness of 4 mm in an analogous manner to Example 3, then cold rolled in a thickness of 0.6 mm, subjected to intermediate annealing by heating up to 390° C. at a heating rate of 20° C./sec and immediately cooling at a cooling rate of 20° C./sec, and then further cold rolled in a thickness of 0.3 mm to obtain aluminum alloy plates I-3, J-3, K-3, L-3, M-3, N-3, O-3 and P-3. Printing Plates were prepared therefrom in an analogous manner to Example 1 and subjected to assessment of the properties, thus obtaining results shown in Table 8:

TABLE 8

| | Sample No. | | | | | | | |
|---|---|---|---|---|---|---|---|---|
| | I-3 | J-3 | K-3 | L-3 | M-3 | N-3 | O-3 | P-3 |
| | Our Invention | | | | Comparison | | | |
| Alloy No. | I | J | K | L | M | N | O | P |
| Finishing Annealing | no | no | no | no | no | no | no | no |
| Tensile Strength (kg/mm$^2$) | 15.9 | 15.1 | 15.6 | 15.3 | 15.0 | 16.1 | 15.4 | 16.3 |
| Proof Stress (kg/mm$^2$) | 15.7 | 14.9 | 15.4 | 15.1 | 14.8 | 15.8 | 15.3 | 16.2 |
| Elongation (%) | 6 | 7 | 6 | 6 | 4 | 4 | 3 | 6 |
| Electro-chemical | O | O | O | O | O | x | x | x |

TABLE 8-continued

| | Sample No. | | | | | | | |
|---|---|---|---|---|---|---|---|---|
| | I-3 | J-3 | K-3 | L-3 | M-3 | N-3 | O-3 | P-3 |
| | Our Invention | | | | Comparison | | | |
| Alloy No. | I | J | K | L | M | N | O | P |
| Etching Fatigue* ($\times 10^4$) | >10 | >10 | >10 | >10 | 6 | 6 | 6.5 | >10 |
| Heat Softening Resistance | O | O | O | O | x | x | O | O |
| Printability | O | O | O | O | O | x | x | |

Note:
*after burning at 260° C. for 7 minutes

As is evident from the results of Examples 3 to 5, the aluminum alloys of the present invention satisfy all of the electrochemical etching property, fatigue resistance, heat softening resistance and printability, while the comparative aluminum alloys do not satisfy two or more of these properties.

What is claimed is:

1. A lithographic printing plate support comprising a plate formed from an aluminum alloy consisting essentially of Mn in an amount equal to or greater than 0.05% and less than 0.8% by weight, Si in an amount not exceeding 0.2% by weight, Fe in an amount not exceeding 0.5% by weight, Ti in an amount not exceeding 0.1% by weight for fine crystal formation, B in an amount not exceeding 0.02% by weight for fine crystal formation, minor trace impurities, and the balance Al.

2. A lightographic printing plate support according to claim 1, wherein Si is present in an amount between 0.02 and 0.2% by weight.

3. A lithographic printing plate support according to claim 1, wherein Fe is present in an amount between 0.05 and 0.5% by weight.

4. A lithographic printing plate support comprising a plate formed from an aluminum alloy consisting essentially of Mn in an amount equal to or greater than 0.05% and less than 0.8% by weight, Si in an amount between 0.02 and 0.2% by weight, Fe in an amount not exceeding 0.5% by weight, minor trace impurities, and the balance Al.

5. A lithograhic printing plate support comprising a plate formed from an aluminum alloy consisting essentially of Mn in an amount equal to or greater than 0.05% and less than 0.8% by weight, Si in an amount not exceeding 0.2% by weight, Fe in an amount between 0.05 and 0.5% by weight, minor trace impurities, and the balance Al.

* * * * *